United States Patent [19]

Edge et al.

[11] Patent Number: 4,680,143

[45] Date of Patent: Jul. 14, 1987

[54] DETERGENT COMPOSITIONS

[75] Inventors: David J. Edge, Chester; Appaya R. Naik, Merseyside; Melvin Scott, Cheshire, all of England

[73] Assignee: Lever Brothers Company, New York, N.Y.

[21] Appl. No.: 748,150

[22] Filed: Jun. 25, 1985

Related U.S. Application Data

[63] Continuation of Ser. No. 551,457, Nov. 14, 1983, abandoned.

[30] Foreign Application Priority Data

Nov. 16, 1982 [GB] United Kingdom ..... 8232643

[51] Int. Cl.[4] ..... C11D 1/83

[52] U.S. Cl. ..... 252/553; 252/544; 252/546; 252/550; 252/551; 252/558; 252/559; 252/DIG. 14

[58] Field of Search ..... 252/525, 527, 544, 546, 252/550, 551, 553, 558, 559

[56] References Cited

U.S. PATENT DOCUMENTS

| | | | |
|---|---|---|---|
| 3,910,855 | 10/1975 | Abeles | 252/527 |
| 3,936,317 | 2/1976 | Lehmann et al. | 134/29 |
| 4,072,632 | 2/1978 | Reed | 252/541 |
| 4,434,087 | 2/1984 | Hampson et al. | 252/550 |

FOREIGN PATENT DOCUMENTS

| | | |
|---|---|---|
| 183111 | 5/1980 | Czechoslovakia . |
| 71413 | 2/1983 | European Pat. Off. . |
| 71414 | 2/1983 | European Pat. Off. . |
| 147837 | 9/1980 | Hungary . |
| 48-089209 | 11/1973 | Japan . |
| 50-053285 | 5/1975 | Japan . |
| 1343551 | 1/1974 | United Kingdom . |
| 1513550 | 6/1978 | United Kingdom . |
| 2068405 | 8/1981 | United Kingdom . |
| 1604054 | 12/1981 | United Kingdom . |
| 2021141 | 6/1982 | United Kingdom . |
| 2010892 | 6/1982 | United Kingdom . |
| 2104913 | 3/1983 | United Kingdom . |
| 2105325 | 3/1983 | United Kingdom . |
| 2108520 | 5/1983 | United Kingdom . |

*Primary Examiner*—Prince E. Willis
*Assistant Examiner*—Hoa Van Le
*Attorney, Agent, or Firm*—Milton L. Honig; James J. Farrell

[57] ABSTRACT

A high foaming aqueous liquid detergent composition suitable inter alia for manual dishwashing is based on a ternary active detergent system of (a) dialkyl sulphosuccinate, (b) alkylbenzene sulphonate and/or secondary alkane sulphonate and (c) alkyl ether sulphate. This combination gives both performance and formulation (viscosity, hydrotropy) benefits.

9 Claims, No Drawings

DETERGENT COMPOSITIONS

This is a continuation application of Ser. No. 551,457, filed Nov. 14, 1983, now abandoned.

The present invention relates to high-foaming liquid detergent compositions suitable for use in fabric washing, shampoos, and above all, in manual dishwashing operations in both hard and soft water.

The term "dishes" as used herein means any utensils involved in food preparation or consumption which may be required to be washed to free them from food particles and other food residues, greases, proteins, starches, gums, dyes, oils and burnt organic residues.

Light-duty liquid detergent compositions such as are suitable for use in washing dishes are well-known. Many of the formulations in commercial use at the present time are based on a sulphonate-type anionic detergent, especially on alkyl benzene sulphonate, in conjunction with an alkyl polyethoxy sulphate (alkyl ether sulphate). The sulphonate-type detergent generally predominates.

The sulphonate-type detergents most commonly used in dishwashing liquids are alkylbenzene sulphonates and secondary alkane sulphonates. Materials based on linear or near-linear alkyl groups, ie linear alkylbenzene sulphonates and secondary alkane sulphonates, are used in most developed countries for maximum biodegradability.

The linear alkylbenzene sulphonates most useful for dishwashing are those with an alkyl chain length ranging from $C_{10}$ to $C_{12}$. In practice a cut consisting predominantly of $C_{10}$, $C_{11}$ and $C_{12}$ material but also containing small amounts of $C_9$ and $C_{13}$ material (and trace amounts of less than $C_9$ and greater than $C_{13}$ material) is generally used.

More recently, another class of sulphonate-type detergents, the dialkyl sulphosuccinates, has become of interest for use in high-foaming liquid detergent compositions.

GB No. 1 429 637 (Unilever) discloses hand dishwashing compositions containing as detergent-active material a water-soluble salt of a di($C_7$–$C_9$) alkyl ester of sulphosuccinic acid, in combination with an alkyl sulphate or an alkyl ether sulphate. If desired, other unspecified detergents may also be present.

GB No. 2 108 520, GB No. 2 104 913, GB No. 2 105 325, EP No. 71413 and EP No. 71414 (Unilever) disclose certain dialkyl sulphosuccinates, particularly those having $C_6$ and $C_8$ chains, and their use in detergent compositions alone and in combination with other detergent-active materials.

U.S. Pat. No. 3,910,855 (Abeles), GB No. 1 343 551 (Kao Soap), GB No. 1 604 054 (Elf Aquitaine) and Hungarian Pat. No. 174,837 (Szentirmay) disclose surfactant mixtures for various purposes that contain inter alia dialkyl sulphosuccinates and alkylbenzene sulphonates.

The present invention is based on the observation that in light-duty liquid detergent compositions, the use of a particular ternary combination of detergent-active materials—a dialkyl sulphosuccinate, an alkyl benzene sulphonate and/or secondary alkane sulphonate, and an alkyl ether sulphate—gives advantages both in terms of performance and, above all, in terms of formulation benefits.

The present invention accordingly provides a foaming liquid detergent composition in the form of a stable aqueous solution containing from 5 to 60% by weight of an active detergent mixture comprising (a) a water-soluble salt of a dialkyl ester of sulphosuccinic acid in which the alkyl groups may be the same or different, in an amount of at least 2% by weight based on the total composition, (b) a $C_9$–$C_{15}$ alkylbenzene sulphonate and/or a $C_{10}$–$C_{18}$ secondary alkane sulphonate, and (c) a $C_{10}$–$C_{18}$ alkyl ether sulphate.

The total active detergent level is preferably from 10 to 40% by weight, more preferably from 16 to 40% by weight.

The weight ratio of (a) plus (b) to (c) is preferably within the range of from 8:1 to 0.5 to 1, more preferably from 6:1 to 1:1, and advantageously from 3.5:1 to 1.5:1.

The weight ratio of (a) to (b) is preferably within the range of 4:1 to 0.1:1, more preferably from 2.5:1 to 1:1.

The compositions of the invention exhibit substantially better foaming performance than corresponding compositions in which the dialkyl sulphosuccinate is replaced by the same weight of sulphonate-type detergent (alkyl benzene sulphonate or secondary alkane sulphonate). The compositions of the invention also, however, have advantages over corresponding compositions in which the sulphonate-type detergent is replaced by the same weight of dialkyl sulphosuccinate, despite the better performance of the latter compositions, in that viscosity is much higher. Viscosities of 150 cp or more are very much easier to achieve using the ternary active system of the invention then when using a system in which dialkyl sulphosuccinate is the only sulphonate-type detergent present.

The clarity and stability of the compositions of the invention are also greatly improved owing to the presence of component (b), and the hydrotrope requirement lowered. Difficulties have been encountered in preparing clear, stable liquid detergent compositions based on dialkyl sulphosuccinates and alkyl ether sulphates. At relatively high ratios of sulphosuccinate to ether sulphate (3:1 and above) relatively large quantities of hydrotrope are required in order to obtain stable solutions having acceptable clear and cloud points, and in some cases acceptable formulations cannot be obtained even using large quantities of hydrotrope. Hydrotropes are materials present in a formulation to control solubility, viscosity, clarity and stability, but which themselves make no active contribution to the performance of the product. Examples of hydrotropes include lower aliphatic alcohols, especially ethanol; urea; lower alkylbenzene sulphonates such as sodium toluene and xylene sulphonates; and combinations of these. Hydrotropes are expensive and take up room in a formulation without contributing to its performance, and it is therefore desirable to use as small quantities of them as possible.

Accordingly, the compositions of the invention contain in the active detergent system three distinct components (a), (b) and (c) which must all be present.

The composition of the invention may if desired contain other detergent-active materials within its active detergent mixture, provided that at least 2% by weight of the whole composition is constituted by dialkyl sulphosuccinate(s). Preferably at least 1% by weight, more preferably at least 4% by weight, of the composition is constituted by component (b), and at least a further 1%, more preferably at least 4% by component (c).

The dialkyl sulphosuccinate component (a) may if desired be constituted by a mixture of materials of different chain lengths, of which the individual dialkyl sulphosuccinates themselves may be either symmetrical (both alkyl groups the same) or unsymmetrical (with two different alkyl groups).

The detergent-active dialkyl sulphosuccinates are compounds of the formula I:

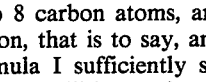

$$\begin{array}{l} CH_2 — CH — SO_3X_1 \\ \quad | \qquad\quad | \\ COOR_1 \quad COOR_2 \end{array} \qquad (I)$$

where each of $R_1$ and $R_2$, which may be the same or different, represents a straight-chain or branched-chain alkyl group having from 3 to 12 carbon atoms, preferably from 4 to 10 carbon atoms and more preferably from 6 to 8 carbon atoms, and $X_1$ represents a solubilising cation, that is to say, any cation yielding a salt of the formula I sufficiently soluble to be detergent-active. The solubilising cation $X_1$ will generally be monovalent, for example, alkali metal, especially sodium; ammonium; or substituted ammonium, for example, ethanolamine. Certain divalent cations, notably magnesium, are however also suitable.

The alkyl groups $R_1$ and $R_2$ are preferably straight-chain or (in mixtures) predominantly straight-chain.

Among dialkyl sulphosuccinates that may advantageously be used in the composition of the invention are the $C_6/C_8$ unsymmetrical materials described and claimed in European Patent Application No. 82 303869 (Unilever) (Case C.1305); the dioctyl sulphosuccinate/-dihexyl sulphosuccinate mixtures described and claimed in European Patent Application No. 82 303868 (Unilever) (Case C.1304/1); and the mixtures of symmetrical and unsymmetrical dialkyl sulphosuccinates described and claimed in European Patent Application No. 82 303867 (Unilever) (Case C.1304).

Component (b) is a $C_9$–$C_{15}$, preferably $C_9$–$C_{13}$, alkylbenzene sulphonate which is preferably linear. It may be used in the form of the salt of any suitable solubilising cation. Examples of suitable materials include Dob (Trade Mark) 102 ex Shell, Marlon (Trade Mark) A ex Chemische Werke Hüls, and Sirene (Trade Mark) X12L ex Societá Italiana Resine, and Ucane (Trade Mark) 11 ex Union Carbide.

Alternatively or additionally component (b) may comprises a $C_{10}$–$C_{18}$ secondary alkane sulphonate, for example, SAS 60 ex Hoechst.

Component (c) comprises an alkyl ether sulphate, preferably a material of the general formula II $$R_3—O—(CH_2CH_2O)_n—SO_3X_2 \qquad (II)$$

wherein R is a linear or branched $C_{10}$–$C_{18}$ alkyl group, $X_2$ is a solubilising cation, and n, the average degree of ethoxylation, is from 1 to 12, and more especially 1 to 8. In any particular commercially available alkyl ether sulphate a range of different chain lengths and differently ethoxylated materials will be present; the degree of ethoxylation n represents an average figure, and, for example, a material for which n is 3 will include individual materials ranging from n=0 (alkyl sulphate) to perhaps n=10.

Advantageously, an ether sulphate having an n-value of 2 or 3 is used. Mixtures of an ether sulphate and a corresponding alkyl sulphate, giving a lower overall n value, may also be used in the compositions of the present invention.

According to a preferred embodiment of the invention, a primary alkyl ether sulphate is used which contains 20% or less by weight of $C_{14}$ and above material, preferably less than 10% by weight and more preferably substantially none. The content of $C_{11}$ and shorter-chain material is advantageously also as low as possible, and most advantageously a sulphate consisting predominantly of $C_{12}$ and $C_{13}$ material is used. Exemplary of such a product is the Dobanol (Trade Mark) 23 series ex Shell. This consists of 50% $C_{12}$ material and 50% $C_{13}$ material, and is substantially free of other chain lengths; overall, the $C_{12}$ and $C_{13}$ material is 75% straight-chain and 25% 2-methyl branched.

If desired, component (c), the alkyl ether sulphate, may be supplemented by an ethoxylated nonionic detergent having an alkyl chain length of from $C_8$ to $C_{15}$ and a degree of ethoxylation of from 5 to 14. Suitable nonionic detergents include short-chain high-foaming ethoxylated alcohols of the general formula III:

$$R_4—O—(CH_2CH_2O)_m—H \qquad (III)$$

wherein $R_4$ is an alkyl group, preferably straight-chain, having from 8 to 12 carbon atoms, and the average degree of ethoxylation m is from 5 to 12. An especially preferred nonionic detergent is Dobanol (Trade Mark) 91-8 ex Shell, in which $R_4$ is $C_9$–$C_{11}$ (predominantly straight-chain) and m is 8. The ratio of alkyl ether sulphate to nonionic detergent is preferably least 1:1, more preferably 3:1 to 1.5:1.

The compositions of the invention will generally also contain minor amounts of one or more hydrotropes.

As indicated previously, suitable hydrotropes include lower aliphatic alcohols, especially ethanol; urea; lower alkylbenzene sulphonates such as sodium toluene and xylene sulphonates; and combinations of these.

As well as active detergent, water and (if necessary) hydrotrope, the compositions may contain the usual minor ingredients such as perfume, colour, preservatives and germicides.

The liquid detergent compositions of the invention, containing 5 to 60% by weight of active detergent in stable aqueous solution, may be used for all normal detergent purposes where foaming is advantageous, for example, fabric washing products, general purpose domestic and industrial cleaning compositions, carpet shampoos, car wash products, personal washing products, shampoos, foam bath products, and, above all, manual dishwashing.

The invention is further illustrated by the following non-limiting Examples, in which the dialkyl sulphosuccinate used was a statistical mixture (mole ratio 1:2:1) of di-n-octyl sulphosuccinate, n-hexyl n-octyl sulphosuccinate and di-n-hexyl sulpho-succinate (sodium salts), prepared from a 1:1 mixture of n-hexanol and n-octanol by the method described in Example 1 of GB No. 2 108 520 (Unilever).

EXAMPLE 1

Liquid detergent compositions were prepared as shown in the following Table. Composition 1 is in accordance with the invention, and Compositions A, B, C and D are comparative.

The alkylbenzene sulphonate used was Dob (Trade Mark) 102 ex Shell, sodium salt, and the alkyl ether sulphate used was Dobanol (Trade Mark) 23-3A ex Shell (n=3, ammonium salt).

The foaming performances of the various formulations were compared using a plate washing test. In the test, plates soiled with a standard starch/fat/fatty acid mixture were washed in a standard manner with 5 liters of test solution (total concentration of the product 1 g/liter in 5° H. or 24° H. (French hardness) water at 45° C.) in a bowl, until only a third of the surface of the solution in the bowl was covered with foam. The number of plates washed before this arbitrary end-point was reached was taken as an indicator of dishwashing and foaming performance.

| Example | 1 | A | B | C | D |
|---|---|---|---|---|---|
| Dialkyl sulphosuccinate | 12 | 20 | 20 | — | — |
| Alkylbenzene sulphonate | 8 | — | — | 20 | 20 |
| Alkyl ether sulphate | 8 | 8 | 8 | 8 | 8 |
| Urea | 10 | 10 | 15 | 10 | 10 |
| Ethanol | — | — | — | — | 5 |
| Viscosity (cp) | 327 | unstable at room temp. | 140 | 1200 | 264 |
| Cloud point (°C.) | −5 | | −1 | <−10 | <−10 |
| Plates test | | | | | |
| 24° H | 27 | 32 | 32 | 24 | 24 |
| 5° H | 34 | 39 | 39 | 27 | 27 |

It will be seen that Composition 1 exhibited a good performance, as demonstrated by the plates test, and an acceptably high viscosity. For stability about 10% of urea hydrotrope was required. In Composition A the alkylbenzene sulphonate had been replaced by dialkyl sulphosuccinate and although the performance was even better than that of Composition 1 it was impossible to obtain a stable composition at the same urea level; raising the urea level to 15% (Composition B) gave a single-phase formulation but the viscosity was lower than that of Composition 1, and the cloud point higher.

In Composition C the dialkyl sulphosuccinate was omitted in favour of alkylbenzene sulphonate and the drop in performance will be noted. The viscosity was also so high that handling would be very difficult. To reduce this to a workable level the addition of ethanol (Composition D) was necessary.

EXAMPLE 2

The procedure of Example 1 was repeated at a higher total active detergent level (40% by weight). In this experiment the foaming performances were compared by means of a modified Schlachter-Dierkes test based on the principle described in Fette und Seifen 1951, 53, 207. A 100 ml aqueous solution of each material tested, having a concentration of 0.05% active detergent in 5° H. or 24° H. water at 45° C., was rapidly oscillated using a vertically oscillating perforated disc within a graduated cylinder. After the initial generation of foam, increments (0.2 g) of soil (9.5 parts commercial cooking fat, 0.25 parts oleic acid, 0.25 parts stearic acid and 10 parts wheat starch in 120 parts water) were added at 15-second intervals (10 seconds' mild agitation and 5 seconds' rest) until the foam collapsed. The result was recorded as the number of soil increments (NSI score). Each result was the average of 4 runs.

As will be seen from the Table, Composition 2 gave an NSI score in 24° H. water of 48, which was very close to that given by a commercially available premium quality dishwashing liquid (49). Comparative Composition E, in which the alkylbenzene sulphonate had been replaced by dialkyl sulphosuccinate, gave a better score but its viscosity was low. The corresponding alkylbenzene sulphonate formulation, Composition F, was so viscous as to be classified as a gel, and its foaming performance was poor.

| | 2 | E | F |
|---|---|---|---|
| Dialkyl sulphosuccinate | 18 | 27 | — |
| Alkylbenzene sulphonate | 9 | — | 27 |
| Alkyl ether sulphate | 13 | 13 | 13 |
| Urea | 12 | 12 | 12 |
| Ethanol | 4 | 4 | 4 |
| Viscosity (cp) | 172 | 85 | gel |
| Cloud point | 2 | 1 | |
| NSI Score | | | |
| 24° H | 48 | 59 | 33 |
| 5° H | 53 | 64 | 38 |

EXAMPLES 3 AND 4

A composition according to the invention containing secondary alkane sulphonate instead of alkylbenzene sulphonate was prepared. The alkane sulphonate was SAS 60 ex Hoechst. This composition was compared with Composition 1 of Example 1 and with a similar composition (Composition 4) containing more urea.

| | 3 | 1 | 4 |
|---|---|---|---|
| Dialkyl sulphosuccinate | 12 | 12 | 12 |
| Alkylbenzene sulphonate | — | 8 | 8 |
| Alkane sulphonate | 8 | — | — |
| Alkyl ether sulphate | 8 | 8 | 8 |
| Urea | 8 | 10 | 12 |
| Viscosity (cp) | 260 | 327 | 298 |
| Cloud point | −8 | −5 | <−10 |
| NSI Score | | | |
| 24° H | 25 | 27 | 27 |
| | 33 | 34 | 34 |

It will be seen that Composition 3 displayed excellent viscosity, cloud point and plate-washing performance, although the latter was slightly lower than that of the corresponding alkylbenzene sulphonate system. The cloud point was better than that of Composition 1, but addition of more urea (Composition 4) improved the cloud point of the alkylbenzene sulphonate system without undue viscosity reduction.

EXAMPLES 5–9

The following compositions according to the invention containing total active detergent levels ranging from 29 to 34% were prepared. All were clear stable homogeneous liquids having cloud points of −8° C. or below and viscosities above 200 cp.

| | 5 | 6 | 7 | 8 | 9 |
|---|---|---|---|---|---|
| Active detergent | 33 | 33 | 32 | 31 | 29 |
| Sulphosuccinate | 16 | 2.5 | 15 | 2.5 | 2.5 |
| Dob 102 | 8.5 | 21 | 8 | 17.5 | 15.5 |
| Dobanol 23-3A | 9.5 | 11 | 9 | 11 | 11 |
| Urea | 15 | 8 | 14 | 6 | 5.5 |

EXAMPLES 10–15

The following compositions according to the invention containing total active detergent levels ranging from 23 to 28% were prepared. All were clear stable homogeneous liquids having low cloud points.

| | 10 | 11 | 12 | 13 | 14 | 15 |
|---|---|---|---|---|---|---|
| Active detergent | 28 | 27 | 27 | 26 | 25 | 23 |
| Sulphosuccinate | 13 | 13 | 11 | 12 | 13 | 10 |
| Dob 102 | 7 | 6 | 8 | 6 | 4 | 6 |
| Dobanol 23-3A | 8 | 8 | 8 | 8 | 8 | 7 |
| Urea | 12 | 12 | 12 | 12 | 12 | 10 |

EXAMPLES 16–19

The following compositions according to the invention containing total active detergent levels ranging from 16 to 20% by weight were prepared. All were stable homogeneous liquids having low cloud points. Composition 16 contained a different alkylbenzene sulphonate, Ucane (Trade Mark) 11 ex Union Carbide, and Compositions 17 and 19 contained a different ether sulphate, Lutensit (Trade Mark) 2270 ex BASF.

| | 16 | 17 | 18 | 19 |
|---|---|---|---|---|
| Active detergent | 20 | 19 | 18 | 16 |
| Sulphosuccinate | 10 | 10 | 10 | 8 |
| Dob 102 | — | — | 4 | — |
| Marlon A | — | 4 | — | 4 |
| Ucane 11 | 4 | — | — | — |
| Dobanol 23-3A | 6 | — | 4 | — |
| Lutensit 2270 | — | 5 | — | 4 |
| Urea | 10 | 10 | 10 | 10 |

We claim:

1. A foaming liquid detergent composition in the form of a stable aqueous solution containing from 16 to 40% by weight of an active detergent mixture comprising (a) a water-soluble salt of a dialkyl ester of sulphosuccinic acid in which the alkyl groups may be the same or different, in an amount of at least 2% by weight based on the total composition, (b) a $C_9$–$C_{15}$ alkylbenzene sulphonate, and (c) a $C_{10}$–$C_{18}$ alkyl ether sulphate, wherein the weight ratio of (a) to (b) is from 4:1 to 0.1:1 and the weight ratio of (a)+(b) to (c) is from 2.5:1 to 1:1.

2. The detergent composition of claim 1, wherein the weight ratio of (a) to (b) is within the range of from 4:1 to 1:1.

3. The detergent composition of claim 1, wherein component (b) constitutes at least 4% by weight of the total composition.

4. The detergent composition of claim 1, wherein component (c) constitutes at least 4% by weight of the total composition.

5. The detergent composition of claim 1, wherein the alkyl groups of the dialkyl sulphosuccinate (a) each have from 4 to 10 carbon atoms.

6. The detergent composition of claim 5, wherein the alkyl groups of the dialkyl sulphosuccinate (a) each have from 6 to 8 carbon atoms.

7. The detergent composition of claim 1, wherein component (c) comprises an alkyl ether sulphate containing 20% or less of $C_{14}$ and higher chain length material.

8. The detergent composition of claim 7, wherein component (c) comprises an alkyl ether sulphate substantially free of $C_{14}$ and higher chain length material.

9. A foaming liquid detergent composition in the form of a stable aqueous solution containing from 16 to 40% by weight of an active detergent mixture comprising (a) a water-soluble salt of a dialkyl ester of sulphosuccinic acid in which the alkyl groups may be the same or different, in an amount of at least 2% by weight based on the total composition, (b) a $C_9$–$C_{15}$ alkylbenzene sulphonate, and (c) a $C_{10}$–$C_{18}$ alkyl ether sulphate, wherein the weight ratio of (a) to (b) is from 4:1 to 1:1 and the weight ratio of (a)+(b) to (c) is from 2.5:1 to 1:1, said detergent composition having a viscosity of from about 150 cp to about 327 cp at 25° C.

* * * * *